US007121198B2

(12) United States Patent
Dumenil

(10) Patent No.: US 7,121,198 B2
(45) Date of Patent: Oct. 17, 2006

(54) SCREEN-PRINTING MACHINE WITH A DEVICE FOR TRANSFERRING OBJECTS TO BE PRINTED

(75) Inventor: Francois Dumenil, Chaumes en Brie (FR)

(73) Assignee: Machines Dubuit, Noisy le Grand (FR)

( * ) Notice: Subject to any disclaimer, the term of this patent is extended or adjusted under 35 U.S.C. 154(b) by 111 days.

(21) Appl. No.: 11/010,296

(22) Filed: Dec. 14, 2004

(65) Prior Publication Data

US 2005/0132908 A1 Jun. 23, 2005

(30) Foreign Application Priority Data

Dec. 17, 2003 (FR) ..... 03 14836

(51) Int. Cl.
*B41F 17/00* (2006.01)
*B66C 1/00* (2006.01)

(52) U.S. Cl. ..... 101/35; 101/40; 101/40.1; 414/729; 414/738; 901/27; 901/28; 901/29; 901/15; 901/17

(58) Field of Classification Search ..... 101/35, 101/40, 40.1; 414/226.01, 223.02, 758, 757, 414/729, 738; 901/15, 17, 27, 28, 29
See application file for complete search history.

(56) References Cited

U.S. PATENT DOCUMENTS 3,096,709 A * 7/1963 Eldred et al. ..... 101/115
3,181,457 A * 5/1965 Eldred et al. ..... 101/124
3,923,166 A * 12/1975 Fletcher et al. ..... 414/4
4,263,846 A * 4/1981 Eldred et al. ..... 101/40
4,787,310 A * 11/1988 Tiemann ..... 101/40
4,828,453 A * 5/1989 Martin et al. ..... 414/738
4,907,504 A 3/1990 Harris
5,155,423 A * 10/1992 Karlen et al. ..... 318/568.11
5,249,663 A * 10/1993 McCoy et al. ..... 198/468.2
5,711,216 A * 1/1998 Tiemann et al. ..... 101/40.1
5,746,565 A * 5/1998 Tepolt ..... 414/744.5
6,213,011 B1 * 4/2001 Dubuit ..... 101/35
2003/0019371 A1 * 1/2003 Platel et al. ..... 101/35

FOREIGN PATENT DOCUMENTS

FR 2 775 472 9/1999

* cited by examiner

*Primary Examiner*—Ren Yan
*Assistant Examiner*—Matthew Marini
(74) *Attorney, Agent, or Firm*—Young & Thompson

(57) ABSTRACT

The screen-printing machine (10) comprises:
a print station (12);
at least one support surface (40A, 40B) for supporting the objects away from the print station (12); and
at least one transfer device (18, 20) for transferring an object, which transfer device comprises a manipulator arm (54) equipped with an end clamp (56), the arm (54) being hinged relative to the support surface (40A, 40B) about a pivot axis (Z1-Z1) and the clamp (56) being hinged relative to the arm (54) about a tilt axis. The pivot axis (Z1-Z1) of the arm (54) defines with the normal to the support surface (40A, 40B) a non-zero angle of inclination that is less than 45°. Application to printing flasks.

9 Claims, 5 Drawing Sheets

SCREEN-PRINTING MACHINE WITH A DEVICE FOR TRANSFERRING OBJECTS TO BE PRINTED

The present invention relates to a screen-printing machine of the type comprising:

a print station comprising a squeegee and a screen support for supporting a screen-printing screen, and an object holder for holding an object to be printed, the screen support and the squeegee being mounted to move relative to each other;

at least one support surface for supporting the objects away from the print station; and at least one transfer device for transferring an object between a support surface and the object holder, which transfer device comprises:

a manipulator arm equipped with an end clamp, the arm being hinged relative to the support surface about a pivot axis and the clamp being hinged relative to the arm about a tilt axis that is offset angularly from the pivot axis; and synchronization means for synchronizing the movement of the arm and the movement of the clamp for moving the transfer device between a position in opposition to the support surface and a position in opposition to the print station.

BACKGROUND OF THE INVENTION

As is known per se, circularly symmetrical objects are printed in a screen-printing machine by turning the object about its own longitudinal axis and by concomitantly moving a screen in a plane tangential to the object, with ink being transferred through the screen by a squeegee being pressed against said screen, the screen being squeezed between the object and the squeegee.

Flat objects such as compact disks can also be printed by screen-printing. They are then held stationary under the screen which is also stationary, and the squeegee is moved over the length of the-screen to transfer the ink progressively to the flat object.

Such machines are used for repetitively printing identical objects.

Solutions have been proposed in order to automate putting the objects in place in the print station and removing them therefrom. In such machines, the objects to be printed are brought into the vicinity of the print station by a feed conveyor, and they are then transferred from the conveyor to the print station by a transfer device. In addition, a symmetrical other transfer device transfers the printed objects from the print station to a removal conveyor.

On the conveyors, the objects to be printed are generally disposed with an orientation different from the orientation of the objects in the print station.

More precisely, when the objects to be printed are flasks, they are placed vertically on the surface of the conveyor with their longitudinal axes disposed perpendicularly to the surface of the conveyor. Whereas, in the print station, the objects must be disposed with their longitudinal axes disposed generally horizontally, i.e. perpendicularly to the initial orientation direction of the objects on the conveyor.

Therefore, the transfer device interposed between the feed conveyor and the print station is suitable for moving the object all the way between the outlet end of the conveyor and the print station while also simultaneously turning the object over.

The opposite movement must be provided by the other transfer device in order to transfer the printed object from the print station to the removal conveyor.

Such loading and/or unloading handling devices are described, for example, in Documents FR-2 775 472 and U.S. Pat. No. 4,907,504.

In those documents, the transfer device comprises a manipulator arm equipped with an end clamp. The arm is hinged relative to the frame of the print station to pivot about an axis extending exactly perpendicularly to or parallel to the support surface for supporting the objects on the feed conveyor. The clamp is hinged relative to the arm so that the arm and the clamp are moved concomitantly.

With such a device, it is observed that, for objects whose bases are relatively wide, the periphery of the base hits the surface of the conveyor during the initial stage in which the object is moved towards the print station. Tilting the object by turning the clamp starts while the object is still in contact with the conveyor. Thus, the periphery of the base of the object exerts a pressure on the conveyor, thereby generating large forces in the transfer device and in the conveyor, reducing their lives.

Likewise, it is observed that such forces exist while the objects are being put in place in the print station. In addition, excessive forces are also encountered by the transfer device for removing the printed objects and transferring them to the removal conveyor.

OBJECTS AND SUMMARY OF THE INVENTION

An object of the invention is to propose a printing machine in which the transfer device is not subjected to large forces during the initial and final stages of moving the object to or from the print station.

To this end, the invention provides a printing machine of the above-mentioned type, wherein the pivot axis of the arm defines with the normal to the support surface a non-zero angle of inclination that is less than 45°.

According to particular embodiments, the machine has one or more of the following characteristics:

the pivot axis is offset relative to the segment connecting the support-surface to the print station, and the pivot axis extends away from the normal to the support surface in the same direction as said normal;

said angle of inclination lies in the range 1° to 20°;

the pivot axis and the tilt axis of the clamp are non-perpendicular;

the tilt axis extends in a plane parallel to the plane of the screen-printing screen that is defined by the screen support when the transfer device is in its position in opposition to the print station;

said synchronization means comprise a reference bevel gear disposed on the pivot axis and a drive bevel gear for driving the clamp carried by the arm as the arm pivots about the pivot axis, which drive bevel gear is movable in rotation about its own axis relative to the arm and is meshed with the reference bevel gear so that it turns when the arm pivots;

the axis of the drive bevel gear of the clamp is perpendicular to the pivot axis and defines a non-zero angle with the tilt axis about which the clamp tilts, the clamp and said drive bevel gear being coupled together so that they are constrained to rotate with each other by a universal joint;

the machine further comprises means for moving the reference bevel gear in rotation relative to the arm independently of the movement of the arm; and in the print station, the screen support is movable in translation between a position away from the object holder for holding an object to be printed and a position close to the object holder, and said machine further comprises a control unit suitable for sequencing the movement of the screen support between its away and close positions and for transferring an object between a support surface and the object holder by means of the transfer device.

BRIEF DESCRIPTION OF THE DRAWINGS

The invention will be better understood on reading the following description which is given merely by way of example and with reference to the accompanying drawings, in which.

MORE DETAILED DESCRIPTION

Figure 1:
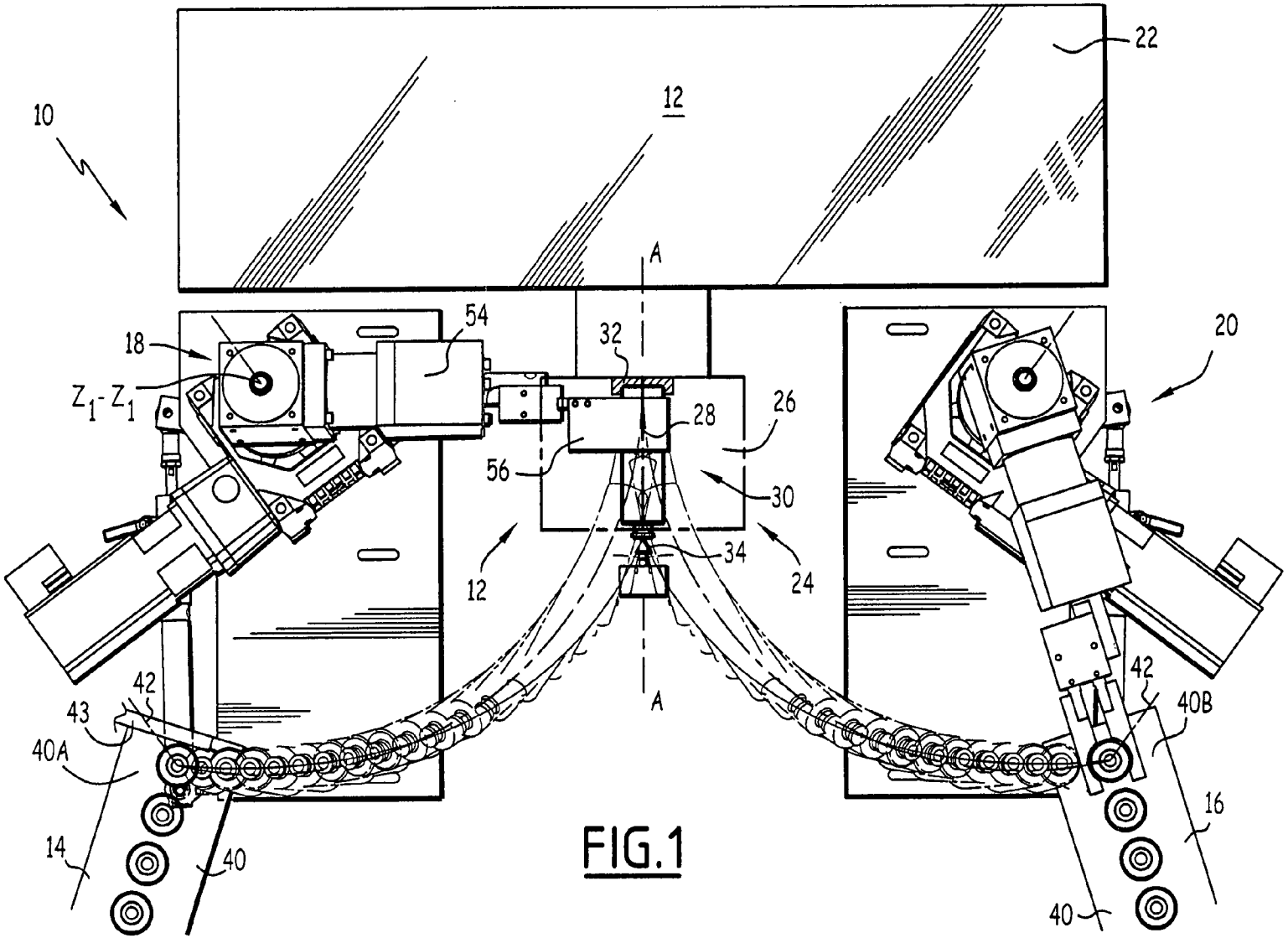
FIG. 1 is a plan view of a printing machine of the invention.

For example, the printing machine 10 of the invention is designed for printing flasks. It essentially comprises a screen-printing print station 12, a feed conveyor 14 for feeding in objects to be printed and a removal conveyor 16 for removing printed objects, and, between each conveyor 14, 16 and the print station, 12, a respective transfer device referenced 18, 20, one transfer device being suitable for loading objects onto the print station, and the other being suitable for unloading objects therefrom.

The machine further comprises a control unit for controlling the print station 12, the two conveyors 14, 16, and the transfer devices 18, 20 so that operation of them is synchronized, as is known per se.

Figure 2:
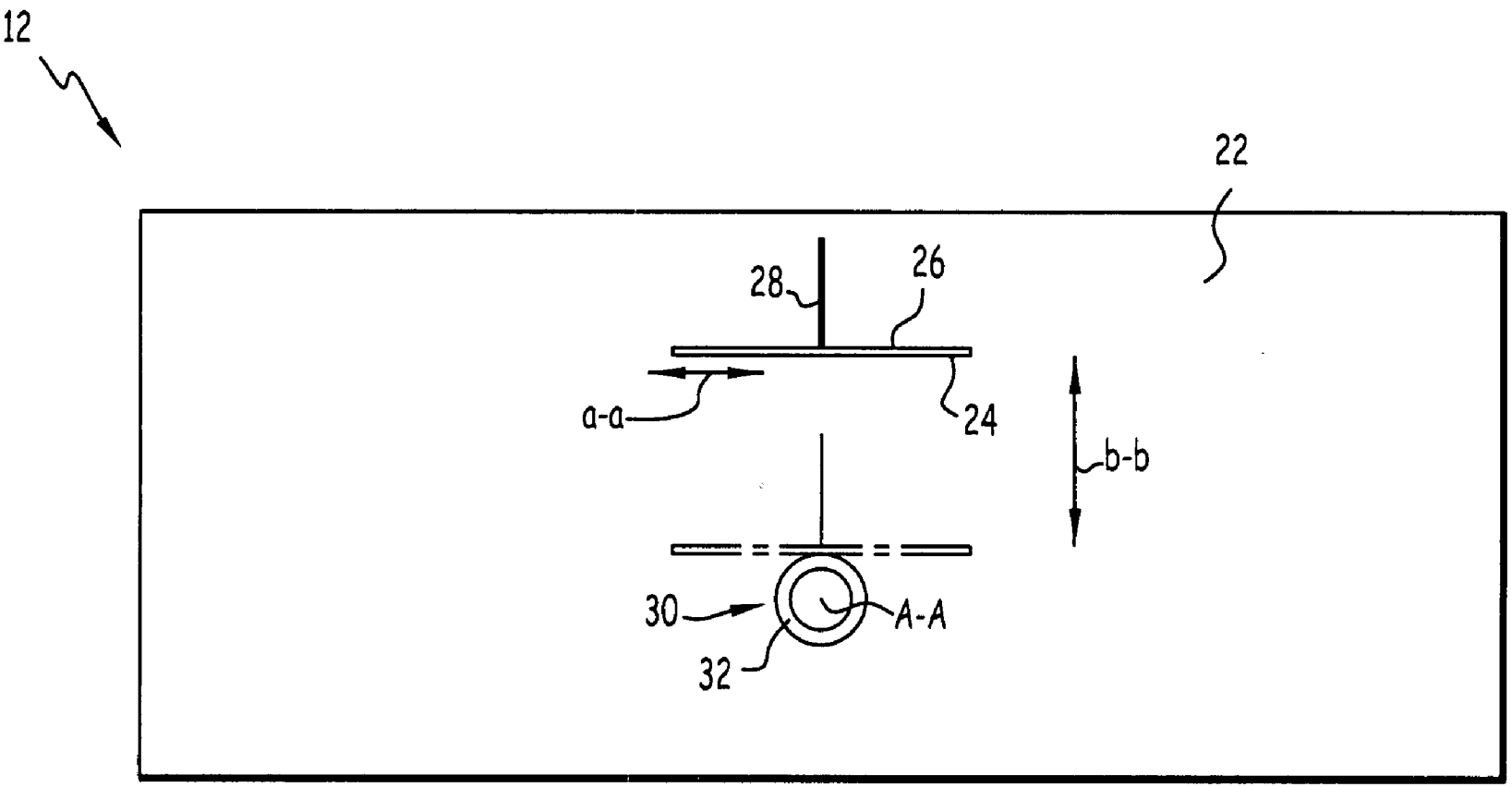
FIG. 2 is a front view of the print station on its own.

The print station 12, shown in a front view in FIG. 2, has a frame 22 that extends generally vertically and a cradle 24 for supporting a screen-printing screen 26. The cradle is mounted to move in translation along a side face of the frame in a horizontal plane in a direction a—a.

A stationary squeegee 28 is disposed opposite to the cradle 24 and bearing against the top surface of the screen 26. In addition, the print station includes means 30 for retaining an object to be printed and for driving it in rotation. Said means comprise a rotary socket 32 defining a cavity of shape matching the shape the bottom of the object to be printed. The socket is mounted to turn about an axis A—A that is perpendicular to the direction of movement of the screen. Means for driving the socket in rotation about its axis are disposed in the frame 22. Facing the cavity and along the axis of rotation A—A of the socket, a spike 34 is disposed for retaining the object to be printed, as shown in FIG. 1. The spike is mounted to slide towards and away from the socket in order to squeeze the object to be printed axially between the socket 32 and the spike 34.

The means 30 for retaining and driving the object to be printed, which means are constituted by the socket and by the spike, are prevented from moving in translation relative to the frame 22 in the plane perpendicular to the axis A—A. Conversely, the squeegee 28 and the cradle 24 carrying the screen 26 are mounted to move in translation relative to the frame 22 between a position away from the axis A—A as shown in continuous lines in FIG. 2 and a position close to the axis as shown in dashed lines. This movement takes place in a direction b—b in a plane that is perpendicular to the plane of the screen and that contains the axis of rotation A—A.

The conveyors 14, 16 are identical, and each of them comprises a looped conveyor belt 40 held between two parallel deflector rollers 42, one of which is motor-driven. The conveyors 14, 16 define respective support surfaces 40A, 40B for supporting the objects, which surfaces extend in a common plane which is preferably horizontal.

The objects to be printed are disposed one behind the other on the conveyor. An abutment 43 for stopping the objects is disposed at the downstream end of the feed conveyor 14 so as to retain the objects until they are removed by the transfer device 18.

The transfer devices 18 and 20 are mutually symmetrical about a vertical midplane. Thus, only the device 18 is described in detail, in particular with reference to FIGS. 3 and 4.

Said transfer device 18 essentially comprises a support plate 50, a base 52 secured to the plate, an arm 54 mounted to pivot relative to the base 52 about an axis Z1-Z1 and a clamp 56 for grasping the objects, which clamp extends the arm 54. The clamp is mounted to pivot relative to the arm 54 about an axis R1-R1.

The plate 50 is constituted by a plane rigid sheet. It is secured relative to the conveyor 14 and to the frame 22 in a position such that said plate extends parallel to the support surface 40A for supporting the objects at the outlet-end of the conveyor 14.

The pivot axis Z1-Z1 of the arm 54 defines an angle with the base 50 and thus with the support surface 40A for supporting the objects at the outlet of the conveyor, said angle being a non-zero angle smaller than 45° and preferably lying in the range 1° to 20°.

As shown in FIG. 1, the pivot axis Z1-Z1 of the arm 54 is offset relative to the print station and to the conveyor outside the segment connecting the outlet end of the conveyor 14 to the print station 12, and said pivot axis extends substantially on the mean perpendicular of said segment.

Thus, the axis Z1-Z1 is equidistant from the outlet end of the conveyor 14 and from the print station 12. It is inclined so that it extends away from the segment connecting the outlet end of the conveyor 14 to the print station 12 in the same direction as the normal to the support surface 40A, i.e. in the upward direction extending away from said surface.

Figure 3:
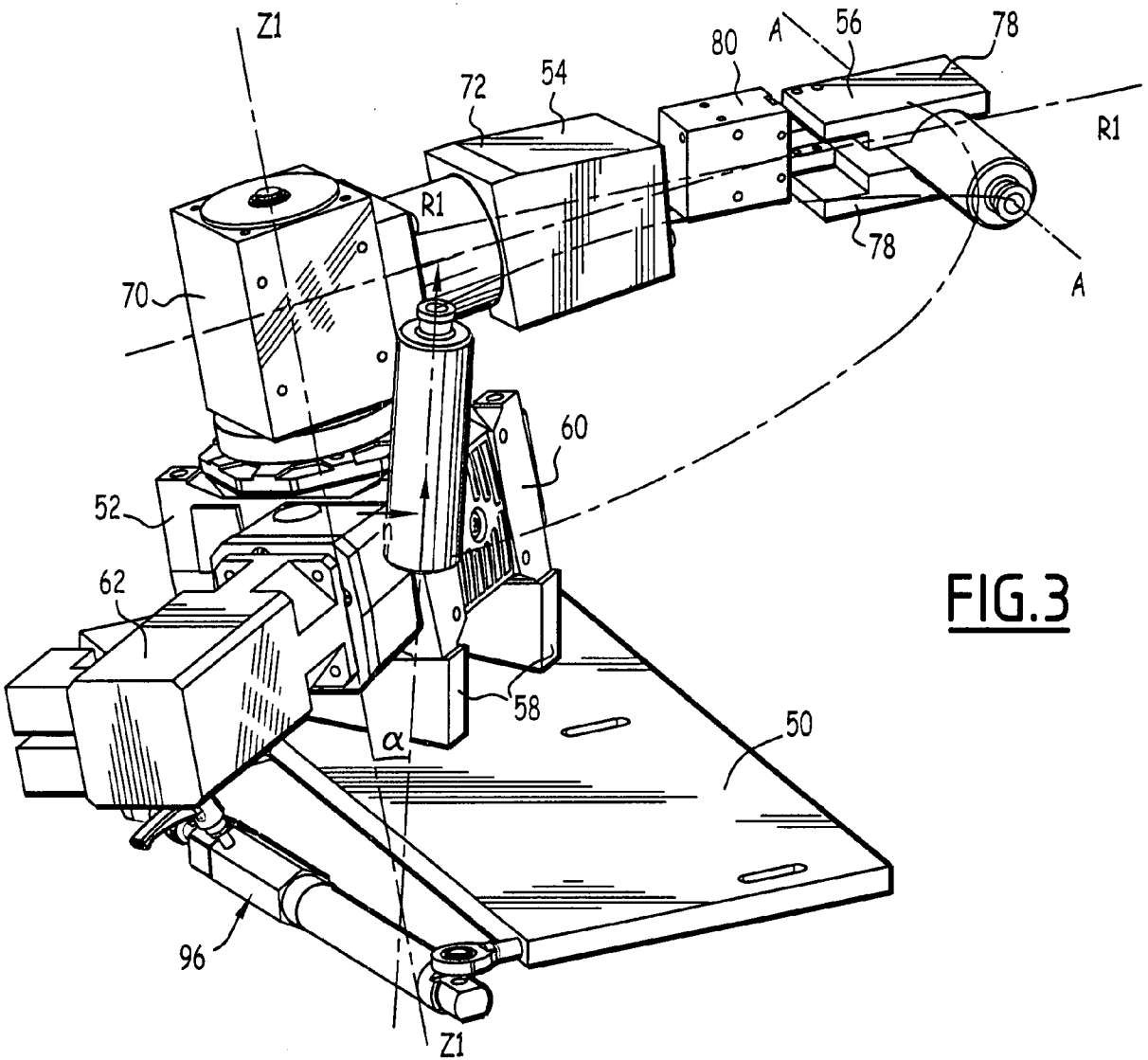
FIG. 3 is a side elevation view of the transfer device for putting the objects in place on the print station.
Figure 4:
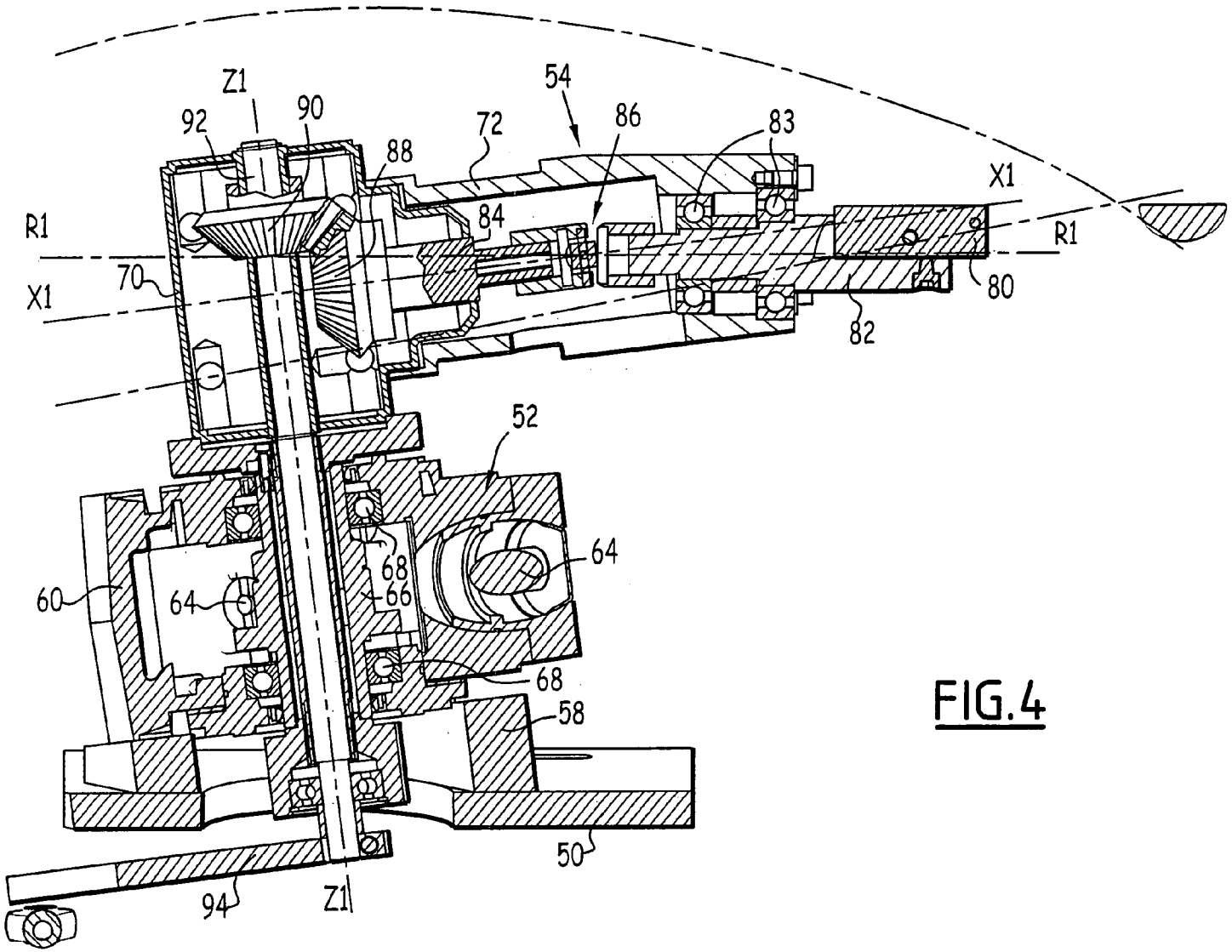
FIG. 4 is a longitudinal section view of the transfer device of FIG. 3.

For this purpose, the base 52 supporting the arm 54 is carried by two wedge-shaped chocks 58 interposed between the plate and the base 52 as shown in FIG. 3.

The base 52 comprises a casing 60 associated with a motor and gearbox unit 62 for driving the arm 54 which is secured to the casing 60 on a side face thereof. A drive shaft 64 that is visible in FIG. 4 and that comes from the motor and gearbox unit 62 projects into the casing. A gearwheel 66 for driving the arm 54 is mounted to turn inside the casing 60. The gearwheel extends along the axis Z1-Z1. It is provided with peripheral fluting adapted to co-operate with complementary fluting provided on the drive shaft 64.

In the embodiment in question, the gearwheel 66 is guided by two ball bearings 68 retained in the casing on either side of the gearwheel.

The arm 54 is provided with a turret 70 extending the gearwheel 66 coaxially on one side and extending generally along the axis Z1-Z1. The gearwheel 66 and the turret 70 are constrained to rotate with each other.

The arm 54 is also provided with a radial extension 72 secured to the turret 70 and extending along an axis X1-X1 that is perpendicular to and that intersects the axis Z1-Z1.

The clamp 56 is carried at the end of the radial extension 72.

As shown in FIG. 3, the clamp 56 comprises two jaws 78 and mechanism 80 for supporting and actuating the jaws. Said support is secured to the end of a shaft 82 mounted to turn about the axis R1-R1 via bearings 83 at the free end of the extension 72.

The support and control mechanism 80 comprises pneumatic actuators for actuating the two jaws 78 which are hinged about axes extending perpendicularly to the axis R1-R1. The mechanism 80 is suitable for moving the jaws apart on either side of the axis R1-R1, making it possible to release an object, and for moving the two jaws towards said axis in order to hold an object between them.

The transfer device includes mechanical means for synchronizing the turning of the clamp 56 about the axis R1-R1 and the turning of the arm 54 about the axis Z1-Z1, so that they move angularly in corresponding and concomitant manner.

The shaft 82 of axis R1-R1 is connected to a primary drive rotary shaft 84 extending inside the extension 72 along the axis X1-X1 via a universal joint 86. The axes R1-R1 and X1-X1 define a non-zero angle that is preferably equal to the angle defined by the axis Z1-Z1 with the normal to the bearing surface 40A for the objects at the outlet of the conveyor 14.

At its end, the shaft 84 is provided with a bevel gear 88 projecting into the turret 70. The bevel gear 88 is in engagement with a complementary bevel gear 90 carried by a shaft 92 extending along the axis Z1-Z1 and passing through the turret 70, through the base 52, and through the plate 50. In particular, said shaft extends through a bore provided axially through the gearwheel 66.

Thus, the bevel gears 88 and 90 form an angle deflector, the bevel gear 88 being mounted to rotate about its own axis relative to the arm 54 and in particular relative to the turret 70 about the axis X1-X1.

At its bottom end projecting from the casing 60 and beyond the plate 50, the shaft 92 is provided with a control crank 94 constrained to rotate with the shaft. At its free end, the crank 94 is secured to the drive rod of an actuator 96 whose other end is secured to the plate 50. For example, the actuator 96 comprises a pneumatic actuator or an incremental motor. The motor and gearbox unit 62 and the actuator 96 are connected to the control unit of the machine, which control unit also causes the movement of the conveyors 14, 16 to be synchronized, causes the spike 34 to move, causes the socket 32 to be moved in rotation, causes the screen 26 and the squeegee 28 to be moved upwards and downwards along the direction b—b, causes the cradle 24 for supporting the screen to move along the direction a—a, and causes the clamp 56 to open and to close via the pneumatic mechanism 80.

The printing machine operates as follows under the control of the control unit which ensures that operation of the various drive elements takes place in sequence.

For objects of cylindrical shape, regardless of whether they are circular or oblong in cross-section, the axis of rotation of the socket 32 extends parallel to the support surface 40A for supporting the objects at the outlet of the conveyor 14. In which case, the actuator 96 is inactive throughout the operating cycle of the machine, so that the bevel gear 90 is held stationary relative to the base 52. The turret 70 is mounted to turn relative to the bevel gear 90 about the axis Z1-Z1 under the action of the motor and gearbox unit 62.

Initially, the screen is assumed to be spaced apart from the object-holder and the grasping device is in its collection position in which it collects an object from the conveyor 14. In this position, in opposition to the support plate 40A, the two jaws 78 are spaced apart from each other on either side of an object. Firstly, the object is clamped between the two jaws by operating the mechanism 80. The motor and gearbox unit 62 is then actuated. The turret 70 turns about the axis Z1-Z1 towards the print station by operating the motor and gearbox unit 62 driving the shaft 64, and the gearwheel 66. While the turret is turning, since the bevel gear 90 is held stationary and since the complementary bevel gear 88 is driven in rotation with the turret 70 about the axis Z1-Z1, the bevel gear 88 turns about its own axis, i.e. about the X1-X1, thereby causing the clamp 56 to turn about the axis R1-R1, the movement in rotation being transmitted by the universal joint 86. Thus, the object retained by the clamp is moved from the conveyor 14 towards the print station 12, and is tilted concomitantly under the action of the clamp 56 turning until it reaches the print station 12 where the transfer device is in its loading position, in opposition to the print station. In this position, the axis R1-R1 is parallel to the plane of the screen 26. The screen and the squeegee are then lowered to the object holder in order to perform the printing under the control of the control unit.

Insofar as the axis Z1-Z1 is offset angularly relative to the plane of the conveyor 14, the object is moved in a plane that is not parallel to the support surface 40A and that is disposed above the plane containing said support surface.

Thus, during this initial stage in which the object is being moved and tilted, said object is driven upwards away from the initial bearing surface 40A, thereby preventing the periphery of the bottom of the object from hitting the conveyor as it is being initially tilted.

Similarly, the inclination of the axis Z1-Z1 facilitates engaging the bottom of the object into the cavity of the socket 32.

Simultaneously with the movement of the transfer device 18, the transfer device 20 moves and tilts an object that has been printed in the print station 12 in the opposite direction towards the removal conveyor 16. The printed object moving in an inclined plane facilitates disengaging it from the cavity and depositing it on the conveyor without the periphery of its bottom acting on the cavity or on the conveyor.

Between the simultaneous transfer stages, an object is printed in the station 12 in a manner known per se by turning the object and by tangentially moving the screen.

Figure 5:
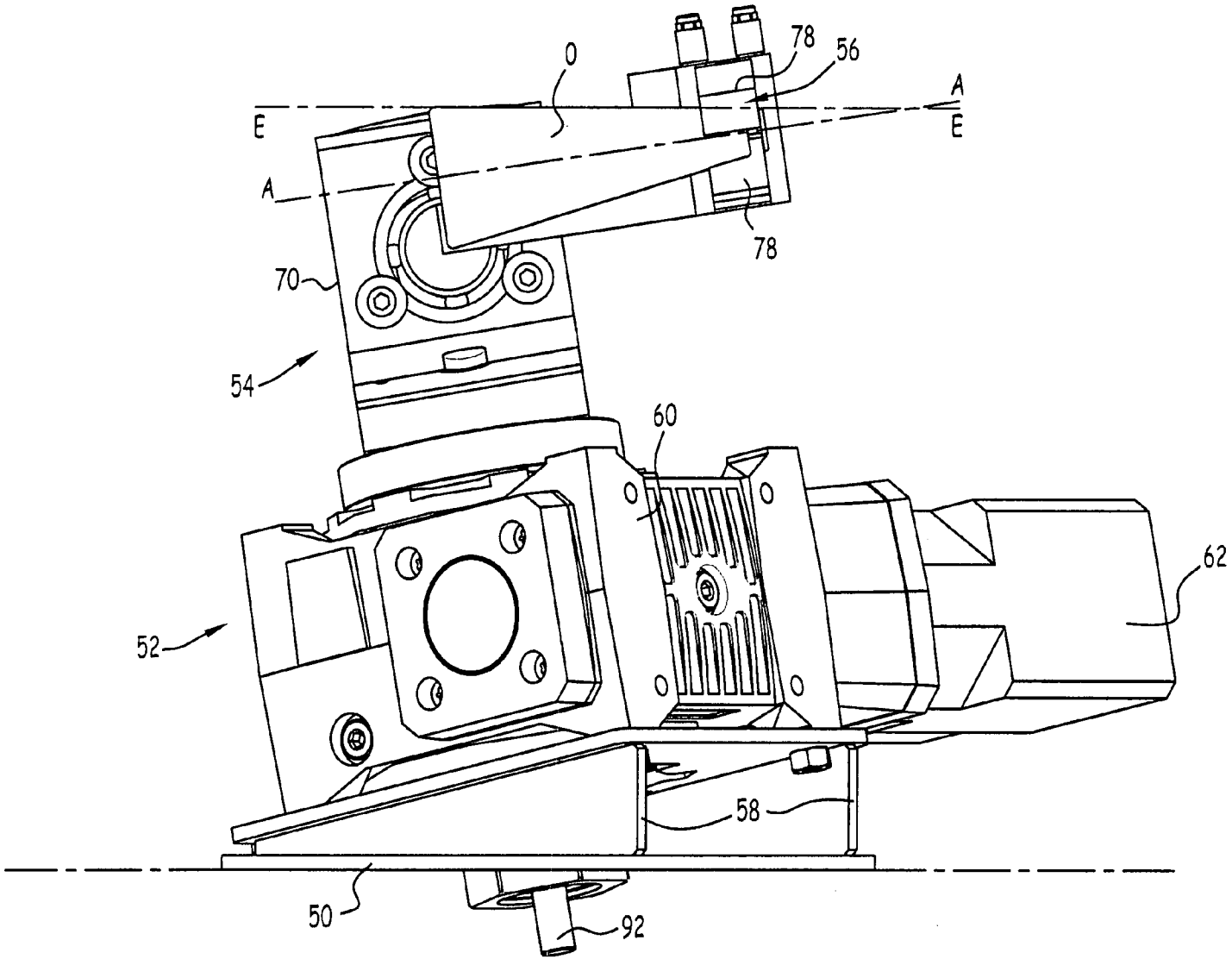
FIG. 5 is an elevation view of a transfer device for putting frustoconical (tapered) objects in place.

When the object to be printed referenced 0 is frustoconical in shape (tapered), as shown in FIG. 5, the axis of rotation A—A of the socket 32 is offset angularly relative to the plane E—E of the screen when said screen is lowered, so that the peripheral surface of the object extends tangentially to the screen.

In particular, in such a case, the axis of rotation of the object during printing is offset angularly relative to the support surface for supporting the objects at the outlet of the conveyor 14. In this particular case, and in order to bring the objects into the print station 12 in a satisfactory angular position, the actuator 96 is activated when the motor and gearbox unit 62 is activated or at the end of activation thereof. Thus, when the turret 70 turns, the bevel gear 90 is moved slightly angularly under the action of the actuator 96, so that the turning of shaft 86, and thus of the clamp 56 is reduced in view of the angular movement of the bevel gear 90.

This particular arrangement makes it possible for the same machine to be used to print cylindrical objects and frustoconical objects, without the bevel gears 88 and 90 being changed in order to modify-the gearing ratio.

In a variant, the installation is equipped with a non-rotary object carrier suitable for receiving flat objects to be printed. In this embodiment, the screen is fixed relative to the object during printing whereas the squeegee is movable in translation along the length of the screen so as to transfer the ink to the object.

What is claimed is:

1. A screen-printing machine (10) comprising:

a print station (12) comprising a squeegee (28) and a screen support (24) for supporting a screen-printing screen (26), and an object holder (30) for holding an object to be printed, the screen support (24) and the squeegee (28) being mounted to move relative to each other;

at least one support surface (40A, 40B) for supporting the objects away from the print station (12); and at least one transfer device (18, 20) for transferring an object between a support surface (40A, 40B) and the object holder (30), which transfer device (18, 20) comprises:

a manipulator arm (54) equipped with an end clamp (56), the arm (54) being hinged relative to the support surface (40A, 40B) about a pivot axis (Z1-Z1) and the clamp (56) being hinged relative,to the arm (54) about a tilt axis (R1-R1) that is offset angularly from the pivot axis (Z1-Z1); and synchronization means for synchronizing the movement of the arm (54) and the movement of the clamp (56) for moving the transfer device between a position opposite to the support surface (40A, 40B) and a position opposite to the print station (12);

wherein the pivot axis (Z1-Z1) of the arm (54) defines with the normal to the support surface (40A, 40B) a non-zero angle of inclination that is less than 45°.

2. A printing machine according to claim 1, wherein the pivot axis (Z1-Z1) is offset relative to the segment connecting the support surface (40A, 40B) to the print station (12), and said pivot axis (Z1-Z1) extending away from the normal to the support surface (40A, 40B) in the same direction as said normal.

3. A printing machine according to claim 1, wherein said angle of inclination lies in the range 1° to 20°.

4. A printing machine according to claim 1, wherein the pivot axis (Z1-Z1) and the tilt axis (R1-R1) of the clamp are non-perpendicular.

5. A machine according to claim 1, wherein the tilt axis (R1-R1) extends in a plane parallel to the plane of the screen-printing screen (26) that is defined by the screen support (24) when the transfer device is in its position in opposition to the print station (12).

6. A printing machine according to claim 1, wherein said synchronization means comprise a reference bevel gear (90) disposed on the pivot axis (Z1-Z1) and a drive bevel gear (88) for driving the clamp (56) carried by the arm (54) as the arm pivots about the pivot axis (Z1-Z1), which drive bevel gear (88) is movable in rotation about its own axis (X1-X1) relative to the arm (54) and is meshed with the reference bevel gear (90) so that it turns when the arm (54) pivots.

7. A printing machine according to claim 6, wherein the axis (X1-X1) of the drive bevel gear (88) of the clamp (56) is perpendicular to the pivot axis (Z1-Z1) and defines a non-zero angle with the tilt axis (R1-R1) about which the clamp (56) tilts, the clamp (56) and said drive bevel gear (88) being coupled together so that they are constrained to rotate with each other by a universal joint (86).

8. A printing machine according to claim 6, further comprising means (92, 94, 96) for moving the reference bevel gear (90) in rotation relative to the arm (54) independently of the movement of the arm.

9. A machine according to claim 1, wherein, in the print station (12), the screen support (24) is movable in translation between a position away from the object holder (30) for holding an object to be printed and a position close to the object holder, and said machine further comprises a control unit suitable for sequencing the movement of the screen support (24) between its away and close positions and for transferring an object between the support surface (40A, 40B) and the object holder (30) by means of the transfer device (18, 20).

* * * * *